US006691534B1

(12) United States Patent
Schönauer et al.

(10) Patent No.: US 6,691,534 B1
(45) Date of Patent: Feb. 17, 2004

(54) LIGHT-SCANNING HEAD FOR KNITTING-MACHINE NEEDLES, A CORRESPONDING LIGHT-SCANNING SYSTEM AND METHOD FOR CHECKING KNITTING-MACHINE NEEDLES, USING SAID LIGHT-SCANNING SYSTEM

(75) Inventors: Michael Schönauer, München (DE); Rainer Bongratz, Otterfing (DE); Torsten Schöne, München (DE)

(73) Assignee: Protechna Herbst GmbH & Co. KG, Ottobrunn (DE)

( * ) Notice: Subject to any disclaimer, the term of this patent is extended or adjusted under 35 U.S.C. 154(b) by 0 days.

(21) Appl. No.: 09/980,530

(22) PCT Filed: Nov. 28, 2001

(86) PCT No.: PCT/EP00/04316

§ 371 (c)(1),
(2), (4) Date: Apr. 10, 2002

(87) PCT Pub. No.: WO00/73565

PCT Pub. Date: Dec. 7, 2000

(30) Foreign Application Priority Data

May 31, 1999 (DE) ..... 199 24 924

(51) Int. Cl.[7] ..... D04B 35/18
(52) U.S. Cl. ..... 66/157
(58) Field of Search ..... 66/165, 157, 161, 66/163; 250/559.29, 221, 559.43; 356/237.1, 237.2

(56) References Cited

U.S. PATENT DOCUMENTS 3,529,445 A * 9/1970 Brose ..... 66/157
3,771,325 A * 11/1973 Sweeney et al. ..... 66/232
3,796,500 A * 3/1974 Obser ..... 66/157
3,904,529 A * 9/1975 Nakamura ..... 66/157
3,937,038 A * 2/1976 Sick ..... 66/157
4,027,982 A 6/1977 Ohishi
5,524,460 A * 6/1996 Michetti et al. ..... 66/165
5,912,816 A * 6/1999 Emery ..... 66/157
6,035,669 A * 3/2000 Gutschmit ..... 66/157
6,318,132 B1 * 11/2001 Gutschmit et al. ..... 66/157

FOREIGN PATENT DOCUMENTS

| | | |
|---|---|---|
| DE | 19 15 362 A | 10/1969 |
| DE | 24 24 957 A | 12/1975 |
| EP | 0 456 126 A | 11/1991 |
| FR | 2136749 A | 12/1972 |
| FR | 2 244 032 A | 4/1975 |
| WO | WO 93 24691 A | 12/1993 |

* cited by examiner

*Primary Examiner*—Danny Worrell
(74) *Attorney, Agent, or Firm*—Sierra Patent Group, Ltd.

(57) ABSTRACT

A light scanning system for needles in knitting machines, more particularly circular knitting machines, with a control unit, which comprises at least a light source and an evaluating unit with a receiver, at least a first (22, 42) and a second (24, 44) light wave conductor, the first light wave conductor (22, 42) having a first end, which is connected to the light source in order to supply light into the first light wave conductor, and having a second end (26), which is secured in a casing (20, 46) for transmitting the light to a needle, and the second light wave conductor (24, 44) having a first end (30), which is secured in the casing (20, 48) so close to the second end (26) of the first light wave conductor (22, 42) that radiation reflected by the needle enters the second light wave conductor (24, 44), and having a second end, which is connected to the evaluating unit, so that the reflected radiation is supplied to the receiver.

19 Claims, 5 Drawing Sheets

1 1 0 1 1 0 1 1 0 1

LIGHT-SCANNING HEAD FOR KNITTING-MACHINE NEEDLES, A CORRESPONDING LIGHT-SCANNING SYSTEM AND METHOD FOR CHECKING KNITTING-MACHINE NEEDLES, USING SAID LIGHT-SCANNING SYSTEM

This application is a 371 of PCT/EP00/04316 Nov. 28, 2001.

This application claims the benefit of German application no. 19 24 924.5 filed on May 31, 1999.

PRIORITY CLAIMED

PRIORITY DATA

BACKGROUND

The invention relates to a light scanning head for needles in knitting machines, more particularly in circular knitting machines, an associated light scanning system and a method for testing needles in knitting machines with the light scanning system.

As a result of the very high loading to which needles are subjected in knitting machines such as, for example, single, fine rib, Jacquard and interlock circular knitting machines, needles of this type often break. In order to prevent the production of large quantities of waste, it should be possible to switch off a circular knitting machine as quickly as possible in the event of breakage of a needle hook or a needle foot.

SUMMARY OF THE INVENTION

It is therefore the object of the invention to provide a testing system which can be easily handled and recognizes a broken needle reliably and in good time.

To this end, according to a first aspect, the invention proposes a light scanning head for needles in knitting machines, with a first light wave conductor, which has a first end for supplying light radiation and a second end for transmitting the light onto a needle, and a second light wave conductor, which has a first end, which lies so close to the second end of the first light wave conductor that radiation reflected by the needle enters the second light wave conductor, and which has a second end, from which the reflected radiation emerges in order to be supplied to an evaluating unit.

According to an embodiment of the invention, the second end of the first light wave conductor and the first end of the second light wave conductor are guided as close as possible up to the needle. In this case, the light wave conductors are preferably formed by optical fibers, particularly preferably by two monofil conductors, whose cross sections, which are preferably circular, contact one another.

In both embodiments, the light wave conductors can be formed by optical fibers, it being possible to arrange the optical fibers of the second light wave conductor between the optical fibers of the first light wave conductor, so that together they form a combined light wave conductor, of which part of the fibers are used for transmitting the light radiation and another part for returning light reflected by the needle.

According to another aspect of the invention, a light scanning system for needles in knitting machines is proposed, with a control unit, which comprises at least a light source and an evaluating unit with a receiver, at least a first and a second light wave conductor, the first light wave conductor having a first end, which is connected to the light source in order to supply light to the first light wave conductor, and a second end, which is arranged for transmitting the light onto a needle, and the second light wave conductor having a first end, which is secured so close to the second end of the light wave conductor that radiation reflected by the needle enters the second light wave conductor, and having a second end, which is connected to the evaluating unit, so that the reflected radiation is supplied to the receiver.

Furthermore, a method for testing needles in knitting machines with a light scanning system is proposed, in which firstly light wave conductors are arranged in such a manner that the needles reflect light transmitted by a first light wave conductor and light reflected by the needles enters the second light wave conductor, then with intact, correctly arranged needles a basic signal sequence of the signals detected by the receiver over one or more runs of the knitting machine or one or more revolutions of the circular knitting machine is recorded and/or a basic signal sequence determined for the given machine is deposited in a store of the control unit, and then prior to or during operation of the machine a signal sequence of the signals detected by the receiver over one or more runs or revolutions of the machine is recorded, which is compared with the basic signal sequence, a fault being reported if the signal sequence cannot be brought into sufficient correspondence with the basic signal sequence.

The measured signals are preferably digitized by means of a threshold criterion, so that the digitized signals represent the frequency of the passage of the needles. In order to detect possible needle breaks, it is then preferable to proceed as follows: From the known running velocity of the knitting machine (that is, for example, the rotational speed in the case of circular knitting machines) and the positions—which are also known for a given machine—of the holders for the needles, which are fitted to a greater or lesser degree with needles according to the knitting pattern, the frequency is determined, at which the individual reflected light signals of the needles which are actually present can occur using the measurement according to the invention. Since the holders for the needles are spaced equidistantly in the machine, reflection signals can only occur at intervals corresponding to the spacing of the needle holders of the machine, i.e. the reflection signals can only occur at frequencies corresponding to an integral multiple of the distance between adjacent needle holders. It is therefore possible to provide a sequence of very short time windows for the evaluating electronics, whose spacing corresponds to the time required by adjacent needles in order to enter the light beam. A given value can then be set for each time window, so that as a result of the given measurement tolerances it is ensured in practice that the reflected light of each needle is measured. In this manner, fault signals which are caused by disturbances between the individual needles, e.g. nap or the like, can be eliminated.

The invention also teaches a particularly preferred method of evaluating the signal sequences recorded during the monitoring of the knitting machine, which are compared with the basic signal sequence as explained above. As defined above, the signal sequence is the measurement result relating to the light reflected by the needles during operation (or optionally during a pause in operation), i.e. the monitoring signal. The basic signal sequence corresponds to the ideal "nominal" state of the needles (i.e. the state with intact needles which are correctly fitted). The comparison of the signal sequence with the basic signal sequence is time-consuming. This means that a certain time span occurs between the measurement of the signal sequence and the receiving of the result relating to the comparison of the signal sequence with the basic signal sequence. This time span should be as short as possible, so that the machine can be switched off as quickly as possible in the event of a fault. If the machine continues to run for too long once a fault has occurred, not only is material unnecessarily lost, but serious damage to the machine can also occur, e.g. as a result of the broken needle. Consequently, it is provided according to a preferred development of the method of the invention that basic signal sequence types corresponding to possible arrangement patterns of the needles are defined and are stored in a computer, a basic signal sequence recorded with intact, correctly arranged needles is associated with one of the basic signal sequence types, and the comparison of the recorded signal sequences with the basic signal sequence is effected as a function of the associated basic signal sequence type.

It is provided in a further preferred embodiment of the method according to the invention that time windows ($\pm\Delta t$) are provided, which can be adjusted during the recording of the basic signal sequence and/or the signal sequence for the occurrence in time of the signals of the reflected light. This development of the invention offers the advantage that the measurement accuracy when determining the signal sequence can be adjusted as a function of the desired quality requirements by the user of the method which is carried out using a correspondingly programmed computer. If the time window is set to be relatively short (narrow), then the needles must be at their provided location with relatively little tolerance. Otherwise a fault would be detected. In contrast, if a relatively long time window is provided, this means that the measurement is relatively tolerant in respect of bending of the needles. For the quotient of the said time window and the time span which lapses between the passage of two directly adjacent needles (with minimum spacing) at the light scanning head, a value of 20%, for example, is provided. This value is adjustable during the monitoring of the machine, depending on the quality requirements.

BRIEF DESCRIPTION OF THE DRAWINGS

The invention will now be described in further detail with the aid of schematic drawings, in which.

DETAILED DESCRIPTION OF THE INVENTION

Figure 1A:
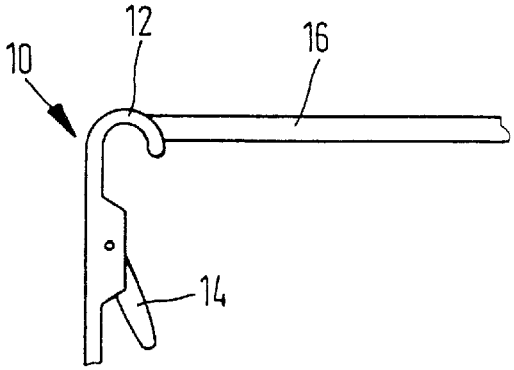
FIG. 1*a* shows a needle, whose hook is scanned by a light beam.
Figure 1B:
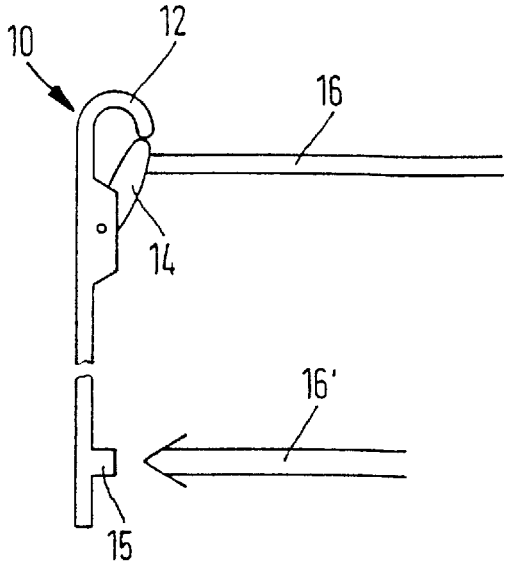
FIG. 1*b* shows a needle, whose latch and/or foot is/are scanned by a light beam.

FIG. 1*a* shows a needle 10, as used in circular knitting machines. The needle 10 has a hook 12 at the top and a latch 14, which is shown in the open position in FIG. 1*a*, in the closed position in FIG. 1*b*. Both the hook 12 and the latch 14 can break off. If the hook 12 is to be monitored, then a beam of light 16 is transmitted onto the front of the hook 2 as in FIG. 1*a*.

Furthermore, it can be provided to also monitor the foot 15 of the needle. To this end, a light beam 16' is accordingly directed onto the foot 15.

If the latch 14 is to be tested, then the light beam 16 is directed onto the latch when it is in the closed position.

Figure 2:
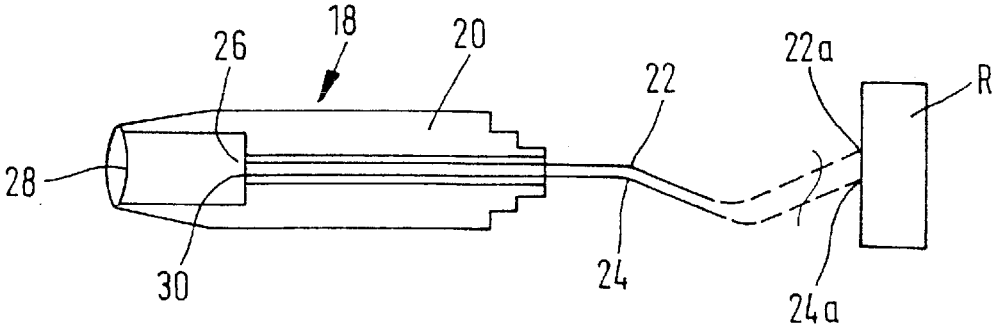
FIG. 2 shows a light scanning head according to the invention for a measuring distance of 20 mm.

FIG. 2 shows a first embodiment of a light scanning head 18 with a casing 20, in which a first light wave conductor 22 and a second light wave conductor 24 are accommodated. The first end 22*a* of the light wave conductor 22 is secured in a control unit R in such a manner that the light of a light source is supplied to the light wave conductor 22. The light emerges at the second end 26 of the light wave conductor and is at least approximately focused onto the needle via a lens 28. The light reflected by the needle passes through the lens partially into the first end 30 of the second light wave conductor 24. The latter's second end 24*a* is secured in the control unit R in such a manner that the light conducted through said second light wave conductor reaches a receiver (not shown) in the control unit and the signal is evaluated by an evaluating unit.

Figure 3A:
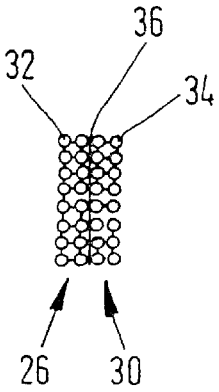
FIG. 3*a* shows the construction of the light wave conductors in the light scanning head of FIG. 2.

In FIG. 3*a*, the construction of the light wave conductors is shown in section. The first light wave conductor 26 is formed by 16 individual photoconductive fibers 32 each having a diameter of 250 $\mu$m. The fibers 32 are arranged adjacent one another in pairs. The second light wave conductor 30 is likewise composed of 16 photoconductive fibers 34 arranged adjacent one another in pairs. The two light wave conductors are separated from one another by a black film 36. In this manner, the two light wave conductors are arranged so close together that the light, which is transmitted by the first light wave conductor 26 and is reflected back by a needle 10 and/or a latch 14, enters the second light wave conductor 30.

Figure 3B:
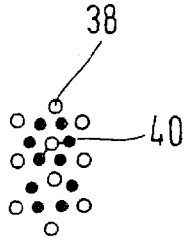
FIG. 3*b* shows an alternative construction of the light wave conductors in the light scanning head of FIG. 2.

FIG. 3*b* shows a different arrangement of the photoconductive fibers of the first and the second light wave conductors. Arranged between the photoconductive fibers 38 shown as black rings are the photoconductive fibers 40 of the second light wave conductor shown as black circular areas, resulting in a combined light wave conductor, whose individual fibers carry out different functions.

Both possible arrangements of the photoconductive fibers are elongated in section (cf. FIG. 3*a*), since with a typical distance of 20 mm between the lens and the needle, the adjustment needs to be such that the needle, which is also elongated, is contacted by a spot of light, but not an adjacent needle.

Figure 4A:
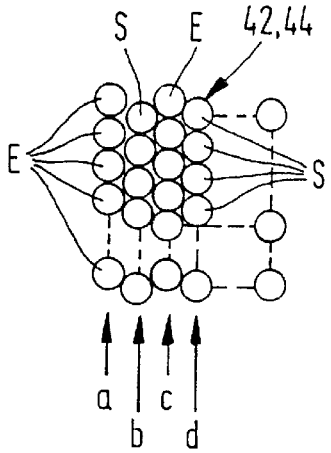
FIGS. 4A, 4B show further embodiments for the construction of the light wave conductors in the light scanning head.
Figure 4B:
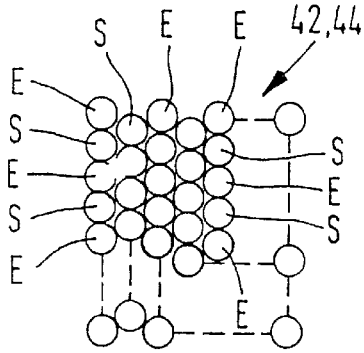

FIGS. 4A and 4B show two preferred embodiments of light wave conductors, which are each composed of a plurality of individual fine photoconductive fibers. FIGS. 4A and 4B are each plan views of the end face of the light wave conductors with the individual photoconductive fibers, which are illustrated in each case as circles. As can be seen, the photoconductive fibers are packed together as close as possible, i.e. the intermediate spaces between the photoconductive fibers are as small as possible. Those glass fiber ends from which light emerges are designated by "S" (for sender/transmitter), those glass fiber ends into which light enters are designated by "E" (for entry).

As can be seen in FIGS. 4A and 4B, the arrangement of the photoconductive fibers is such that a glass fiber end (S) from which light emerges, is surrounded in each case by as many as possible glass fiber ends (E) into which reflected light enters.

In the variant according to FIG. 4A, this is attained in that in each case rows a, b, c, d of glass fiber ends are arranged alternately in such a manner that one row (viewed from top to bottom in FIG. 4A) acts as a light receiver "E", whilst the following row acts as a light transmitter "S" etc. In FIGS. 4A and 4B, not all glass fiber ends are shown, but only a few by way of example. A typical arrangement is 8 to 40 photoconductive fibers per light wave conductor.

In the variant according to FIG. 4B, the arrangement of the photoconductive fibers is such that receiving "E" and transmitting "S" photoconductive fibers alternate in a row in each case. As can be seen from FIG. 4B, this alternation of the functions between adjacent glass fiber ends not only applies to the rows from the top to the bottom, but also in rows of adjacent photoconductive fibers extending at an angle.

It has been found that a substantially improved signal yield can be attained in the embodiments according to FIGS. 4A and 4B. The signal yield can also be further supported in cases where a lens (FIG. 2, 28) is used by adjusting the image so that it is slightly out of focus. This lack of definition of the optical image means that light transmitted by a transmitting glass fiber S, which is reflected at the needle, enters the adjacent, receptive photoconductive fiber E.

Figure 5:
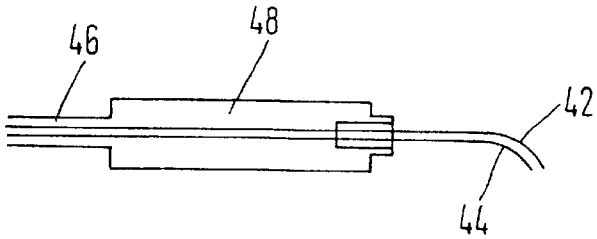
FIG. 5 shows a light scanning head for a measuring distance of a few millimeters between the end of the light wave conductors and the needles.

FIG. 5 shows a second embodiment of a light scanning head, for example for needles in circular knitting machines, in which a first light wave conductor 42 and a second light wave conductor 44 are guided in a guide sleeve 46, which projects from a casing 48, into the vicinity of the needle. In this manner, the distance between the light scanning head and the needle can be reduced to less than 3 mm, preferably less than 2 mm and particularly preferably less than 1 mm. In this case, the light wave conductors have sufficient mechanical stability in order to maintain an adjustment once set. The two light wave conductors can be secured to one another (e.g. by bonding or the like) along their line of contact.

Figure 5A:
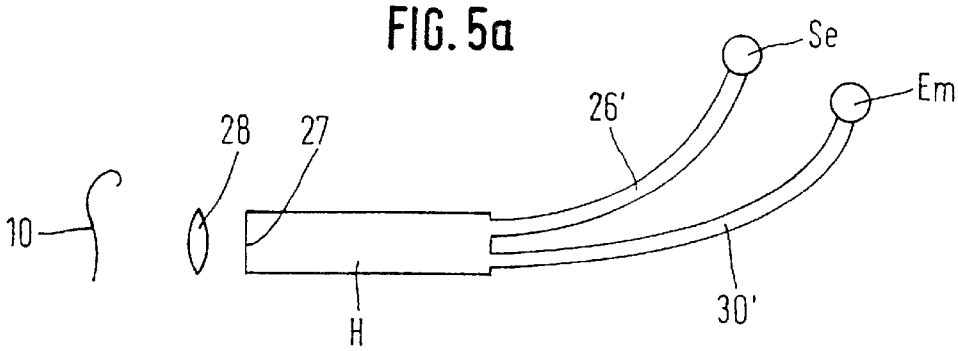
FIGS. 5*a, b, c* show a modification of the construction of light wave conductor and light scanning head.
Figure 5B:
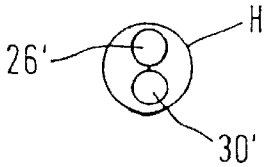
Figure 5C:
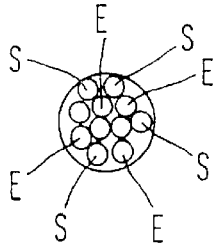

FIG. 5*a* shows a modified embodiment, as compared with the embodiments according to FIGS. 2 to 5, of photoconductive fibers 26', 30', which end in a homogeniser H. The homogeniser H can be, for example, a solid block of photoconductive material. As a result of the homogeniser H, the radiation emerges from its outlet end 27 homogeneously (i.e. extensively uniformly distributed) and is thus directed by the lens 28 onto the needle 10. The radiation reflected by the needle 10 and focused by the lens 28 also passes through the homogeniser H into the photoconductor 30' to the receiver E. This arrangement offers the advantage that the measuring signal is not dependent upon the local position of the respective active photoconductor during the transmission of the radiation to the needle and also during the reception of reflected radiation. FIG. 5*b* is a schematic view of the homogeniser H of FIG. 5*a* from the right, where the light wave conductors 26', 30' open into the homogeniser. As shown, the cross sections of the light wave conductors are approximately dimensioned in such a manner that they extend adjacent one another over the entire diameter of the homogeniser. FIG. 5*c* shows a modification of the embodiment according to FIG. 5*a*, a plurality of light wave conductors being arranged between the transmitter Se and the homogeniser and between the receiver Em and the homogeniser H. The embodiment according to FIG. 5*c* is modified as compared with the embodiment according to FIG. 5*b* in such a manner that the two light wave conductors are replaced by a plurality of light wave conductors, of which one group (S) guides the light from the transmitter Se to the homogeniser H and another group (E) guides the light from the homogeniser H to the receiver Em.

Figures 6A, 6B:
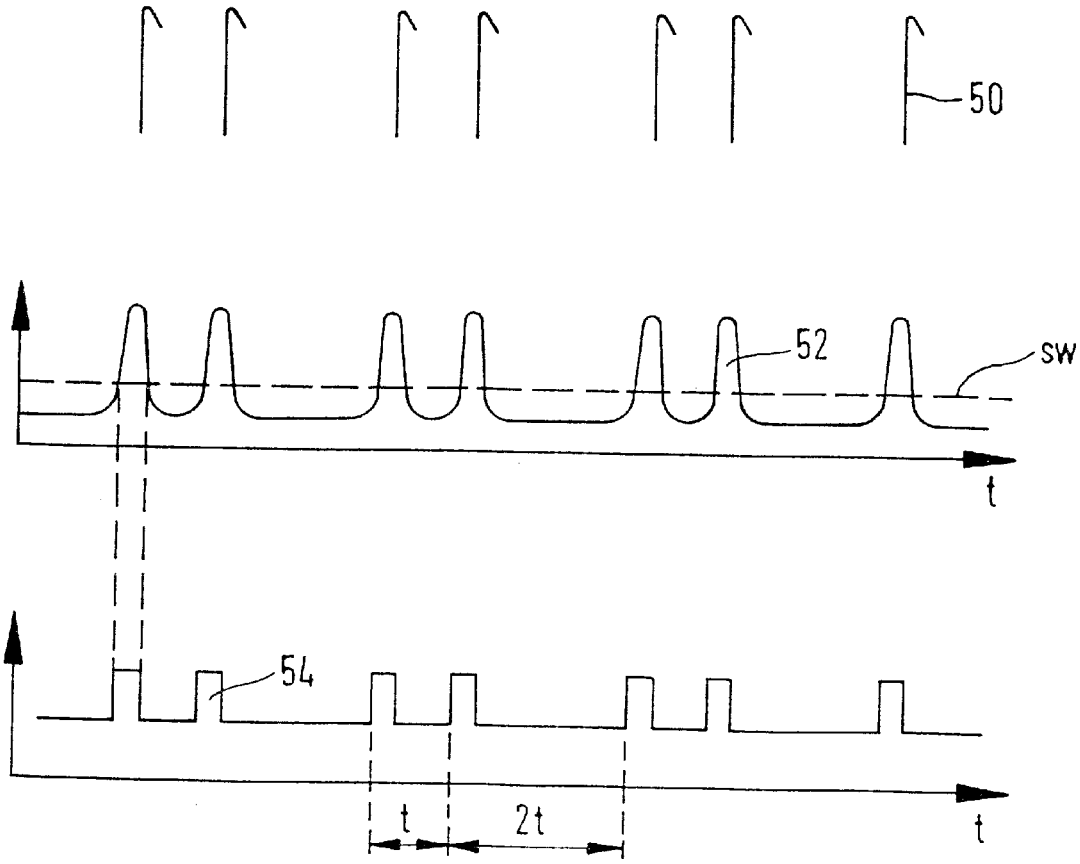
FIG. 6*a* shows an example of a signal of the light reflected by the needles received by a receiver.
FIG. 6*b* shows a signal sequence according to FIG. 6*a* following digitization.

FIG. 6*a* shows a sequence of signals, as are recorded as a function of the time when needles 50, which are represented by the signals, pass through the light beam transmitted by the light scanning head and the reflected light is measured. Each needle 50 corresponds to a pulse 52 in the signal sequence. In the illustrated example, the needles 50 are not uniformly spaced apart; rather, some needles are missing, so that a pattern is formed. In the knitting machine, needle holders are provided equidistantly, although not all needle holders are necessarily fitted with a needle, depending on the knitting pattern to be produced. In the embodiment according to FIG. 6*a*, one needle holder in each case is not occupied between two occupied holders. The time sequence of the signals shown in FIG. 6 corresponds to the velocity of the knitting machine, i.e. the interval t between two signals is the quotient of the geometrical distance between two recesses or holders and the movement velocity of the knitting machine (and therefore also the movement velocity of the needles).

In FIG. 6*b*, the signal levels are respectively recorded above one another on the ordinate above the time scale t, i.e. the levels of the electrical signal generated in the receiver as a result of the reflected light. The upper section of FIG. 6*b* also shows a threshold value SW indicated by a broken line. The pulses 52 are digitized via a threshold value criterion, and square wave pulses 54 are produced. The mean distance between two pulses is either t or an integral multiple thereof. A digital pattern results which can be represented as a numerical sequence, as shown in the lower part of FIG. 6*b*. This pattern represents the knitting pattern. During the installation of the light scanning system, a basic signal sequence is recorded with intact, correctly arranged needles. This basic signal sequence is preferably an average of the signals recorded by the receiver in the control unit over a plurality of revolutions of the circular knitting machine. On the other hand, it is also possible to measure the signal sequence until it reproduces itself, i.e. in a circular knitting machine the revolutions can be measured until the previously measured signal sequence is repeated, or in a linearly operating machine periodic runs can be measured successively until the same signal sequence occurs with sufficient reproducibility. Generally speaking, a plurality of revolutions or runs can therefore be evaluated.

Each time the circular knitting machine is put into operation, a reference signal sequence is recorded, also ideally as an average over a plurality of revolutions of the circular knitting machine. It is clear that these signal sequences do not directly overlap, since the reference signal sequence probably starts with a different needle than the basic signal sequence. Rather a signal sequence must be displaced in time in relation to the other until they overlap. This is also the reason why the reference signal sequence is recorded in addition to the basic signal sequence. If the reference signal sequence does not correspond to the basic signal sequence even with all possible displacements of the zero point, then the circular knitting machine is not set in operation.

Otherwise, the continuously recorded signal sequence is compared with the reference signal sequence during operation of the circular knitting machine. The reference signal sequence provides information relating to the nominal interval to the respective next needle in units of t. If the interval between two pulses exceeds the nominal interval between two pulses by a given threshold value, then this is a criterion for a deviation. The machine is then switched off if this deviation occurs over one or more revolutions of the circular knitting machine.

During the comparison of the basic signal sequence with the signal sequences recorded during the operation of the machine or optionally during an operation pause, it is necessary for the computer to perform a considerable amount of computation during the application of the above method, i.e. the time displacement of the two signal sequences until they overlap (correspond), which under unfavorable circumstances can definitely cost time. However, it is highly desirable to possibly detect a defective or broken needle without a time delay, so that the machine can be switched off as soon as possible after the occurrence of a fault. To this end, a special method is proposed, which will be explained with the aid of FIGS. 7*a* to 7*f*.

Figure 7A:
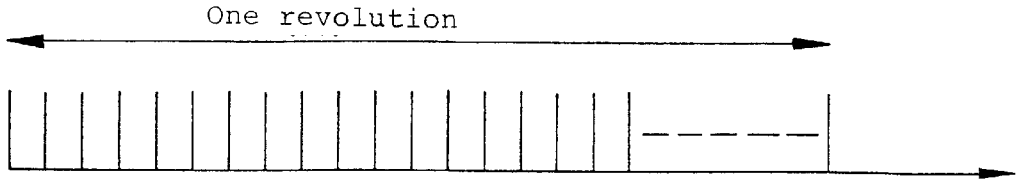
FIGS. 7*a*–7*f* show various basic signal sequence types.
Figure 7B:
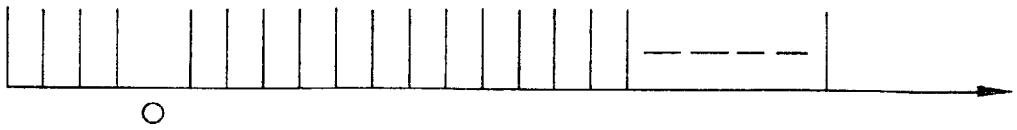
Figure 7C:
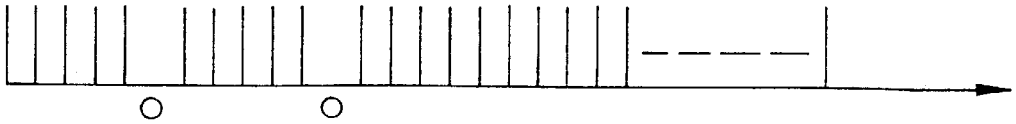
Figure 7D:
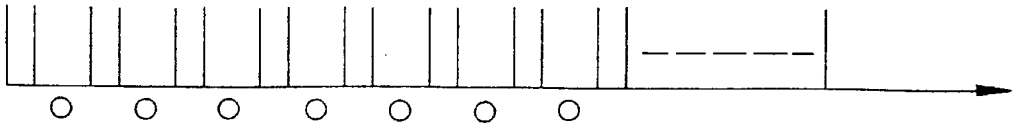
Figure 7E:
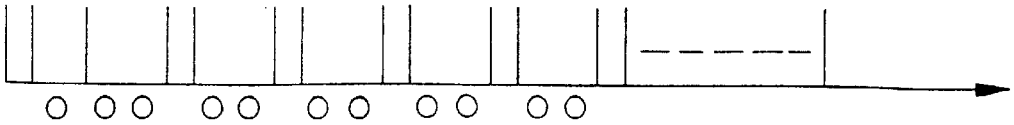
Figure 7F:
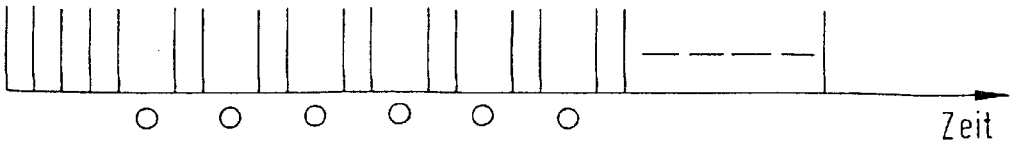

FIGS. 7*a* to 7*f* show possible basic signal sequence types, namely a total of five types, FIGS. 7*e* and 7*f* being interpreted as substantially the same type. FIGS. 7*a* to 7*f* therefore correspond to possible arrangements of needles in the knitting machine, namely the intact needles of the provided arrangement. In other words, FIGS. 7*a* to 7*f* can be understood as direct arrangements of the needles or also as the moments in time when the receiver receives the radiation reflected by the needles. In this context, both are equivalent information. FIGS. 7*a* to 7*f* each show one revolution of a circular knitting machine or a run in the case of a linearly operating machine.

It is understood that the occupied needle positions in FIGS. 7*a* to 7*f* are always designated by a line and the unoccupied needle positions by the symbol "0".

FIG. 7*a* shows a circular knitting machine in which all needle positions are occupied, i.e. the knitted material is manufactured with all needles. This is the first basic signal sequence type. It is immediately clear that the evaluation of a signal sequence measured during operation of the machine with this basic signal sequence type is extremely simple. If a single needle is missing, then the fault is detected immediately according to a simple evaluation algorithm by detecting a single omission or a plurality of omissions. In this case, i.e. in this basic signal sequence type according to FIG. 7*a*, there is basically no need to carry out a displacement of the measured signal sequence until the latter corresponds with the basic signal sequence.

Thus, in this measuring method according to the illustration in FIGS. 7*a* to 7*f*, the basic signal sequence with intact, correctly arranged needles is recorded by the system operator prior to setting the knitting machine in operation using correspondingly programmed software (or this information is entered into the computer in another manner). The computer then determines to which basic signal sequence type (according to FIGS. 7*a* to 7*f*) this actual basic signal sequence corresponds. According to this allocation of the actual basic signal sequence to a basic signal sequence type, the evaluation of signal sequences subsequently measured during the operation of the machine is effected according to correspondingly selected algorithms, it being possible to use different algorithms for each of the different basic signal sequence types, so that the evaluation time can be reduced as much as possible. In other words: this method makes use of the knowledge that all needle arrangement patterns occurring in the knitting machines in question here can be classified in a given, finite number of classes, corresponding to the basic signal sequence types. "Tailored" evaluating algorithms can then be used for these classes for the comparison of the signal sequences measured during operation of the machine with the respective basic signal sequences, which considerably shortens the required computing times and therefore means that the machine can be switched off relatively quickly in the event of a fault.

FIG. 7*b* shows a second basic signal sequence type, in which only one needle is missing. Here too, a simple evaluating algorithm is produced during the comparison of a signal sequence measured during operation of the machine with the basic signal sequence, e.g. it is only necessary to determine whether more than one needle is missing. In contrast, a displacement of the signal sequence until correspondence with the basic signal sequence would require considerably more time.

FIG. 7*c* shows a third basic signal sequence type, in which a plurality of needles are missing and no periodic order within the revolution can be determined. This is the, as it were, "most difficult type" as far as the evaluation is concerned. In this case, the evaluation can be affected, for example, in such a manner that the displacement of the signal sequence is effected until correspondence is reached. However, for the other basic signal sequence types, there is a considerable saving in computing time. The basic signal sequence type according to FIG. 7*c* covers all needle sequences which cannot be classified as one of the other types (FIGS. 7*a, b, d, e, f*). In practice, it occurs relatively seldom.

FIG. 7*d* shows a basic signal sequence type, in which the pattern is strictly periodic, i.e. within the illustrated revolution a given sequence of occupied needle positions and free needle positions repeats numerous times. If a needle pattern according to FIG. 7*d* is present in the knitting machine provided with needles, then it is sufficient to determine the periodicity of the pattern and to take this periodicity into account during the comparison of the signal sequence with the basic signal sequence.

FIGS. 7*e* and 7*f* show two basic signal sequence types with a similar evaluation structure, namely 7*e* a pattern in which there are one or more "negative" disturbances within a period, i.e. a complete periodicity with a deviation ("disturbance") in a single period.

FIG. 7*f* shows a pattern with a structure analogous to FIG. 7*e*, one or more "positive" disturbances occurring within a single period, i.e. a periodicity with a repeating microstructure occurs as far as possible over a revolution, one or more needles being additionally used, which means a more or less reduced disturbance of this pure periodicity. The above-mentioned "disturbances" are not needle faults, but the desired needle pattern. In FIGS. 7*e* and 7*f*, only one "disturbance" is shown in each case.

During the evaluation of a signal sequence in a knitting machine whose needles are fitted according to the basic signal sequence types of FIG. 7*e* or 7*f*, an algorithm is used which relatively quickly produces a result during the comparison of the signal sequence with the basic signal sequence. For example, the region can be determined in which the disturbance sites lie and the signal sequence can be immediately displaced by this time span, so that a deviation between the signal sequence and the basic signal sequence can be determined relatively easily during the comparison.

Figure 8:
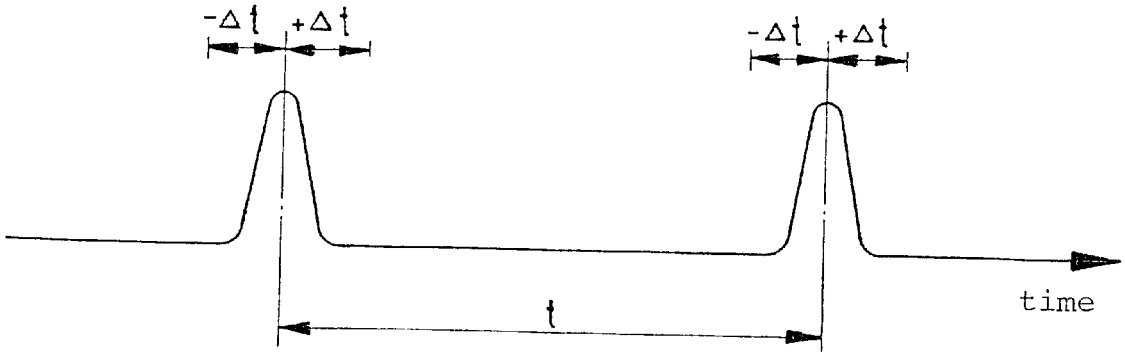
FIG. 8 shows the path over time of signals of the light reflected by the needles with a predeterminable time window.

FIG. 8 shows a detail in the execution of all methods described above, which relates to the occurrence in time of the signal of the reflected light. As explained above, the needles are fitted in the knitting machine according to a desired arrangement pattern or they are actuated according to this pattern. The methods described above are based on a measurement of the light reflected by the needles. In this respect, it is necessary to take into account that the needles can deviate from their ideal nominal position during operation, without this necessarily signifying a fault, e.g. the needles can bend to a greater or lesser extent. During the manufacture of high quality materials, it is necessary for the needles to remain with relative precision in their nominal position. In the case of lower qualities, lesser requirements can be accepted in respect of the correspondence of the actual position of the needles with their nominal position. These different requirements are fulfilled by the variant of the method example which will now be explained with the aid of FIG. 8. FIG. 8 shows by way of example two successive signals over time of a signal sequence. The interval between two successive signals (corresponding to two adjacent needles) is t. The measured light reflected by the needles has the path shown schematically in FIG. 8 for example (i.e. the illustrated pulse form). Thus, according to the spacing of the needles, a signal of reflected light must occur at intervals of t or an integral multiple thereof, the latter applying if one or more needle positions are unoccupied. It is provided in the method of the invention according to this variant that time windows are predetermined for the occurrence in time of the measurement signals, which time windows are illustrated in FIG. 8 by $-\Delta t$ and $+\Delta t$. If the interval At is selected to be relatively small, then the accepted tolerance in respect of the occurrence of the measurement signal is relatively small, i.e. the quality of the product is relatively high. If the time window is adjusted to be relatively large, then relatively lower qualities are also accepted. This adjustability is taken into account during the programming of the provided computer, i.e. the operator of the machine can selectively input different values for the ratio (the quotient) $\Delta t/t$, i.e. values of 5% to 40%.

The devices and methods described above can also be advantageously used in a special type of knitting machine, which produces hosiery or the like, for example. In this case, needles are advanced (electromagnetically or also mechanically in conventional fashion) more or less into operating positions as a function of time. This needle advance is effected in modern systems by the control computer, which in each case controls solenoids associated with the needles. In systems of this type, it is not possible to carry out the methods described above during operation, since the needles are not always in their operating position. However, the method can still be carried out, namely if the light scanning system with its evaluating computer (R) is informed of the occurrence of a recurring monitorable state by one or more control signals derived from the machine. This applies, for example, during pauses between two operating sequences, i.e. in those intervals in which the machine is not actually knitting, i.e. is waiting for the next knitted article which is to be manufactured. During these "pauses", it is possible for example to apply the devices and methods described above, namely in such a manner that the computer control issues a command to all needles to proceed to their provided operating position. In this manner, the needles then have the prescribed arrangement pattern and thus produce a corresponding signal sequence, which can be detected by the light scanning head as described above. The determined basic signal sequence can then be classified, for example, in the classification of the basic signal sequence types and the method explained above can be carried out.

What is claimed is:

1. A light scanning head for needles in knitting machine, having light wave conductors into which radiation is supplied and which receive radiation reflected by the needle and supply it to an evaluation unit, wherein a lens is arranged in a region of ends of the light wave conductors which face the needle.

2. The light scanning head according to claim 1, wherein the light wave conductors form an elongated arrangement in cross-section at said ends of the light wave conductors which face the needle.

3. The light scanning head according to claim 1, wherein the distance between the needle and the lens lies in the region of 5 to 30 millimeters.

4. The light scanning head according to claim 1 wherein the light wave conductors are formed by a plurality of optical fibers, which are packed close together at least at the ends facing the needle, light-transmitting ends and light-receiving ends of the individual fibers wherein a determined number of receiving fiber ends lies in the immediate vicinity of each transmitting fiber end.

5. The light scanning head according to claim 4, wherein light-transmitting fiber ends and light-receiving fiber ends are arranged alternately in rows.

6. A light scanning system for needles in knitting machines, with a control unit, which comprises at least a light source and an evaluating unit with a receiver, at least a first and a second light wave conductor, the first light wave conductor having a first end, which is connected to the light source in order to supply light to the first light wave conductor, and having a second end, which is arranged for transmitting the light onto a needle, and the second light wave conductor having a first end, which is secured so close to the second end of the first light wave conductor that radiation reflected by the needle enters the second light wave conductor, and having a second end, which is connected to the evaluating unit, so that the reflected radiation is supplied to the receiver, wherein at least one of a lens and a homogeniser is arranged in front of the second end of the first light wave conductor and the first end of the second light wave conductor.

7. The light scanning system according to claim 6, wherein the light wave conductors are formed by optical fibers, which together form an elongate arrangement in cross section, the fibers of the first light wave conductor being separated from the fibers of the second light wave conductor in the longer direction by a film.

8. The light scanning system according to claim 6, wherein the distance between the needle and the lens lies in the region of 5 to 30 millimeters.

9. The light scanning system according to claim 6, wherein the light wave conductors are formed by a plurality of optical fibers, which are packed close together at least at their ends facing the needle, light-transmitting ends and light receiving ends of the individual fibers wherein a determined number of receiving fiber ends lies in the immediate vicinity of each transmitting fiber end.

10. The light scanning system according to claim 6, wherein light-transmitting fiber ends are arranged alternately in rows.

11. A method for testing needles in knitting machines, with a light scanning system, comprising light wave conductors are arranged in such a manner that needles passing the light wave conductors reflect light transmitted by a first light wave conductor and light reflected by the needles enters a second light wave conductor in order to record signal sequences relating to the reflected light using a receiver, with intact, correctly arranged needles, a basic signal sequence of the signals detected by the receiver is recorded over at least one of at least one run of the knitting machine and at least one revolution of the circular knitting machine and a basic signal sequence associated with the provided positions of the needles is deposited in a store of the control unit, at least one of before and during operation of the machine, a signal sequence of the signals detected by the receiver is recorded over at least one of at least one run of the machine and at least one revolution of the machine, the recorded signal sequence is compared with the basic signal sequence, a fault being reported if at least one of the signal sequence cannot be brought into sufficient correspondence with the basic signal sequence and if a deviation between the basic signal sequence and the signal sequence is determined.

12. The method according to claim 11, wherein the signals are digitized by means of a threshold value criterion, so that the digitized signals represent the frequency of the passage of the needles.

13. The method according to claim 11, wherein a deviation of the frequency of the signals from the basic signal sequence is determined as a criterion that the correspondence is insufficient.

14. The method according to claim 11, wherein the deviation is determined via a temporal threshold value criterion.

15. The method according to claim 11, wherein for the frequencies of the signals of the signal sequence detected by the receiver, at least one of a value is prescribed and is determined by the device, which corresponds to the movement velocity of the knitting machine and the given spacing of the possible positions of needles, it being determined during said comparison whether the signals have a frequency corresponding to an integral multiple of the minimum spacing between two adjacent needles.

16. The method according to claim 11, wherein basic signal sequence types corresponding to possible arrangement patterns of the needles are defined and are stored in a computer, wherein a basic signal sequence recorded with intact, correctly arranged needles is associated with one of the basic signal sequence types and wherein the comparison of the recorded signal sequence with the basic signal sequence is effected as a function of the associated basic signal sequence type.

17. The method according to claim 11, wherein time windows are adjusted in at least one of during the recording of the basic signal sequence and the signal sequence for the occurrence in time of the signals of the reflected light.

18. The light scanning head according to claim 1 wherein the distance between the needle and the lens lies in the region of 10 to 20 millimeters.

19. The light scanning system according to claim 6, wherein the distance between the needle and the lens lies in the region of 10 to 20 millimeters.

* * * * *

UNITED STATES PATENT AND TRADEMARK OFFICE

CERTIFICATE OF CORRECTION

PATENT NO. : 6,691,534 B1
DATED : February 17, 2004
INVENTOR(S) : Schonauer et al.

It is certified that error appears in the above-identified patent and that said Letters Patent is hereby corrected as shown below:

Title page,
Item [22], please replace "PCT Filed: November 28, 2001" with
-- [22] PCT Filed: May 12, 2000 --

Signed and Sealed this

Thirty-first Day of August, 2004

JON W. DUDAS
*Director of the United States Patent and Trademark Office*